US007137319B2

(12) United States Patent
Hough

(10) Patent No.: US 7,137,319 B2
(45) Date of Patent: Nov. 21, 2006

(54) RATCHET WRENCH

(76) Inventor: William Hough, 3779 Grant Rd. #113, Ellenwoodm, GA (US) 30294

( * ) Notice: Subject to any disclaimer, the term of this patent is extended or adjusted under 35 U.S.C. 154(b) by 0 days.

(21) Appl. No.: 11/286,758

(22) Filed: Nov. 23, 2005

(65) Prior Publication Data

US 2006/0107799 A1 May 25, 2006

Related U.S. Application Data

(60) Provisional application No. 60/630,417, filed on Nov. 23, 2004.

(51) Int. Cl.
*B25B 13/46* (2006.01)
*B25G 23/16* (2006.01)
*B25G 1/00* (2006.01)

(52) U.S. Cl. ..... 81/60; 81/61; 81/63; 81/177.1

(58) Field of Classification Search ..... 81/60, 81/62, 63, 63.2, 177.1, 177.85
See application file for complete search history.

(56) References Cited

U.S. PATENT DOCUMENTS

| | | | | |
|---|---|---|---|---|
| 84,605 A | | 12/1868 | Baxter | |
| 1,310,641 A | | 7/1919 | Welch | |
| 1,370,733 A | | 3/1921 | Crozier | |
| 1,503,084 A | | 7/1924 | Bain | |
| 2,712,258 A | * | 7/1955 | Keith | 81/63 |
| 2,769,360 A | * | 11/1956 | Cottrell et al. | 81/124.3 |
| 4,276,791 A | | 7/1981 | Thompson | |
| 4,748,875 A | * | 6/1988 | Lang | 81/63 |
| 4,819,521 A | * | 4/1989 | Lang | 81/63 |
| 5,199,332 A | * | 4/1993 | Batten | 81/124.1 |
| 5,595,097 A | * | 1/1997 | Anderson | 81/125.1 |
| D403,935 S | * | 1/1999 | Jones | D8/28 |
| 5,865,074 A | * | 2/1999 | Hsieh | 81/124.3 |
| 5,884,538 A | * | 3/1999 | Van Lenten | 81/63 |
| 5,946,987 A | * | 9/1999 | Wei | 81/63.2 |
| D486,366 S | * | 2/2004 | Tuanmu | D8/25 |
| D504,057 S | * | 4/2005 | Tuanmu | D8/25 |
| 2004/0093992 A1 | * | 5/2004 | Wojtynek | 81/57.3 |

* cited by examiner

*Primary Examiner*—Lee D. Wilson
*Assistant Examiner*—Alvin J. Grant
(74) *Attorney, Agent, or Firm*—James Ray & Assoc.

(57) ABSTRACT

A ratchet wrench rotatably operable in a vertical plane for removal and installation of a fastener includes a body with a shank portion and outwardly extending first and second member forming an offset in such body. A first ratchet mechanism disposed in a first head of the wrench attached to the first member and a second ratchet mechanism disposed in a second head attached to the second member are identical except for rotational direction enabling to remove the fastener with one end and install the fastener with the other end of the wrench.

15 Claims, 1 Drawing Sheet

RATCHET WRENCH

CROSS-REFERENCE TO RELATED APPLICATIONS

This application is related to and claims priory from a provisional patent application Ser. No. 60/630,417 filed on Nov. 23, 2004.

FIELD OF THE INVENTION

The present invention relates, in general, to a ratchet wrench and, more particularly, this invention relates to a ratchet wrench having an offset and, yet more particularly, the instant invention is related to a ratchet wrench for use on a fastener for a compressor in a Cummins internal combustion engine.

BACKGROUND OF THE INVENTION

Special tools for internal combustion engines are well known in the art. U.S. Pat. No. 4,276,791 to Thompson discloses a ratchet wrench for use on a clamp nut of a distributor when the timing is to be adjusted. The clamp nut is located in a horizontal plane under an overhang portion of the distributor head and in close proximity to the engine body. The ratchet wrench has an offset shape and a control knob for controlling the rotation of the ratchet mechanism and is rotatably operable in a horizontal plane.

On other engines, such as models 855 and N14 manufactured by Cummins of Columbus, Ind., a need arises to replace or repair a compressor, which is located intermediate the engine body and the cab compartment. To remove the compressor, four fasteners securing the mounting flange of the compressor to a rigid structure must be removed. As it is well known, one of such four fasteners is located underneath the compressor's body and in close proximity to the outer surface of the engine, preventing use of the conventional tools. Accordingly, Cummins offers an s-shaped box wrench, known as Micro Wrench, specifically for removing and installing such fastener. It has been experienced that such s-shaped box wrench can only be rotated, in a vertical plane, a portion of a revolution before the wrench must be removed and repositioned in order to make another partial revolution, thus increasing the effort to remove and reinstall the fastener.

Therefore, there is a need for a ratchet wrench to efficiently remove and install fasteners in locations which are difficult to reach or are characterized by space limitations.

SUMMARY OF THE INVENTION

The invention provides a ratchet wrench rotatably operable in a vertical plane for removal and installation of at least one fastener. Such ratchet wrench includes a body having a shank portion with a first member extending from one end of the shank portion in a first direction and at a first predetermined angle to the shank portion, and a second member extending from an opposed end of the shank portion in a second direction and at a second predetermined angle to the shank portion. A first head, heaving a bore, is disposed at a free end of the first member. A second head, having a bore, is disposed at a free end of the second member. A first ratchet mechanism is engageable with the first head and includes a first ratchet wheel disposed within the bore of the first head, the first ratchet wheel having an internally disposed first polygonal recess having a predetermined shape and an externally disposed predetermined plurality of first ratchet teeth. A first lock pawl is engageable with the predetermined plurality of first ratchet teeth to enable rotation of the first ratchet wheel in a first rotational direction. A second ratchet mechanism is engageable with the second head and includes a second ratchet wheel disposed within the bore of the second head, the second ratchet wheel having an internally disposed second polygonal recess having a predetermined shape and an externally disposed predetermined plurality of second ratchet teeth. A second lock pawl engageable with the predetermined plurality of second ratchet teeth of the second ratchet wheel to enable rotation thereof in a second rotational direction.

OBJECTS OF THE INVENTION

It is, therefore, one of the primary objects of the present invention to provide a ratchet wrench.

Another object of the present invention is to provide for a ratchet wrench for use on internal combustion engines.

Yet another object of the present invention is to provide a ratchet wrench for use on fasteners in locations which are difficult to reach or are characterized by space limitations.

A further object of the present invention is to provide a ratchet wrench for difficult to reach fasteners which is usable for both removing and installing a fastener.

Yet a further object of the present invention is to provide a ratchet wrench for difficult to reach fasteners which decreases time necessary to remove and replace such fasteners.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
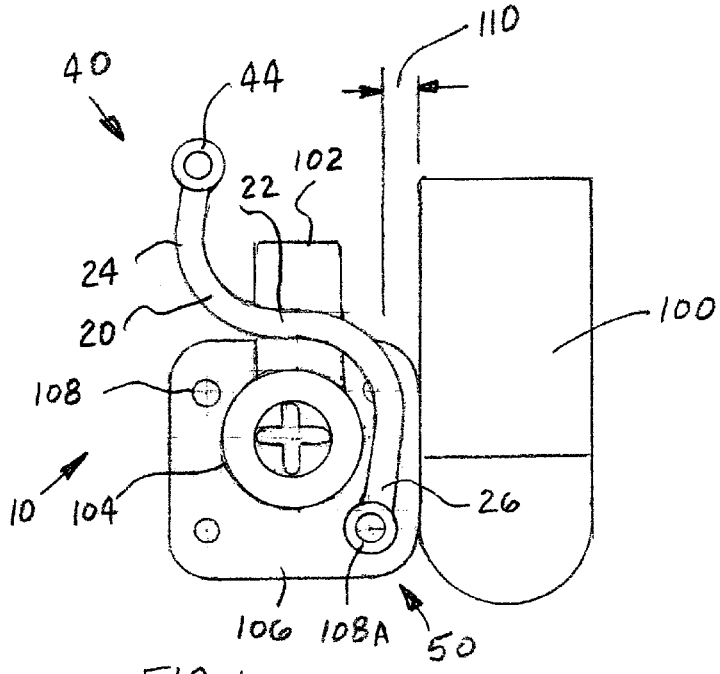
FIG. 1 is a side elevation view of the ratchet wrench of the present invention in use on an internal combustion engine.

Prior to proceeding to the more detailed description of the present invention, it should be noted that, for the sake of clarity and understanding, identical components which have identical functions have been identified with identical reference numerals throughout the several views illustrated in the drawing figures.

Reference is now made, to FIGS. 1–4, wherein there is shown a ratchet wrench, generally designated 10, which includes a body 20 having a shank portion 22, a first member 24 extending from one end of the shank portion 22 in a first direction and at a first predetermined angle to the shank portion 22, and a second member 26 extending from an opposed end of the shank portion 22 in a second direction and at a second predetermined angle to the shank portion 22. Preferably, a transition between the first member 24 and the shank portion 22 is fitted with a first predetermined radius and a transition between the second member 26 and the shank portion 22 is fitted with a second predetermined radius, which is preferably identical to such first predetermined radius.

A first head 30 is disposed at a free end of the first member 24 and has a bore 32. A second head 34 is disposed at a free end of the second member 26 and has a bore 36. In a presently preferred embodiment of the invention, the second direction of the second member 26 is opposite to the first direction of the first member 24 thus forming body 20 of an offset shape. Furthermore, such first member 24 is planar to the second member 26 of the body 20.

Preferably, the body 20, the first head 30 and the second head 34 comprise a unitary member produced by a method being one of casting, forging or molding. The preferred material of the ratchet wrench 10 is steel and, more particularly, tempered or high strength steel.

There is a first ratchet mechanism, generally designated 40, which is engageable with the first head 30. Such first ratchet mechanism 40 includes a first ratchet wheel 42 disposed within the bore 32 of the first head 30. A first lock pawl 48 is engageable with the predetermined plurality of the first ratchet teeth 46 to enable rotation of the first ratchet wheel 42 in a first rotational direction.

A second ratchet mechanism, generally designated 50, is engageable with the second head 34. Such second ratchet mechanism 50 includes a second ratchet wheel 52 disposed within the bore 36 of the second head 34. A second lock pawl 58 is engageable with the predetermined plurality of second ratchet teeth 56 of the second ratchet wheel 52 to enable rotation thereof in a second rotational direction.

According to the presently preferred embodiment of the invention, the first ratchet wheel 42 has an internally disposed first polygonal recess 44 having a predetermined shape and the second ratchet wheel 52 has an internally disposed second polygonal recess 54 having a predetermined shape.

Preferably, the axis of the first ratchet mechanism 40 and the second ratchet mechanism 50 are substantially perpendicular to the plane formed by the shank portion 22, the first member 24 and the second member 26.

Preferably, the second rotational direction of the second ratchet wheel 52 is opposite to the first rotational direction of the first ratchet wheel 42. It is further preferred that the predetermined shape of the internally disposed second polygonal recess 54 of the second ratchet wheel 52 is identical to the predetermined shape of the internally disposed first polygonal recess 44 of the first ratchet wheel 40.

The operation of the ratchet wrench 10 will be given in combination with an internal combustion engine 100 manufactured by Cummins of Columbus, Ind. as model 855 or N14 and further in combination with a compressor 102 having a body 104 and a mounting flange 106 for attachment to such engine 100 with a quartet of fasteners 108. Such compressor 102 is disposed behind the engine 100 and its the mounting flange 106 is disposed perpendicular to the outer surface of the engine 100. The body 104 forms a gap 110 with such outer surface of the engine 100. It has been found that the access to a bottom one of such plurality of fasteners 108, referenced as 108*a*, is only available over the body 104 of the compressor 102 and through the gap 110. Accordingly, the manufacturer (Cummins) offers an s-shaped box wrench (not shown), known as Micro Wrench, specifically for removing and installing such bolt 108*a*. It has been experienced that such s-shaped box wrench (not shown) can only be rotated, in a vertical plane, a portion of a revolution before the wrench (not shown) must be removed and repositioned in order to make another partial revolution, thus increasing the effort to remove and reinstall the fastener 108*a*.

It will be apparent to those skilled in the art that the first ratchet mechanism 40 and the second ratchet mechanism 50 of the presently preferred embodiment of the invention are identical except for rotational direction. Accordingly, one ratchet mechanism will be utilized in removing the fastener 108*a* and the other ratchet mechanism will be utilized in installing such fastener 108*a* which is advantageous in use in oily and greasy conditions. As best shown in FIG. 1, the ratchet wrench 10 is positioned over the compressor 102 and through the gap 110 for reaching the fastener 108*a*. The ratchet wrench 10 is operable in a vertical plane to remove and install such fastener 108*a*. It has been determined that use of the ratchet wrench 10 of the present invention requires only a single engagement and disengagement with the fastener 108*a* during either removal or installation and, accordingly, an effort required to remove or install such fastener 108*a* has been reduced by at least seventy five percent when compared with the effort required for the presently available s-shaped box wrench (not shown). It will be appreciated that the ratchet wrench 10 of the present invention is operable in the vertical plane.

Figure 3:
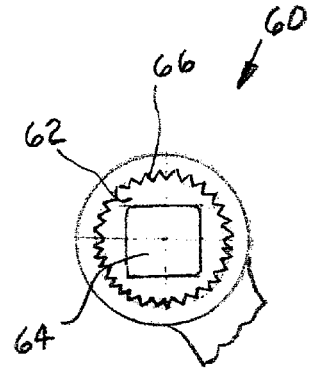
FIG. 3 is a planar view of the ratchet mechanism of one alternative embodiment of the invention.
Figure 4:
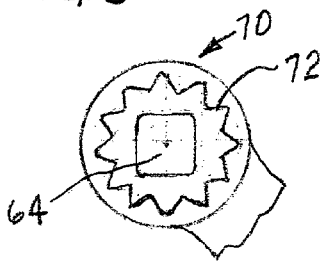
FIG. 4 is a planar view of the ratchet mechanism of another alternative embodiment of the invention.
Figure 2:
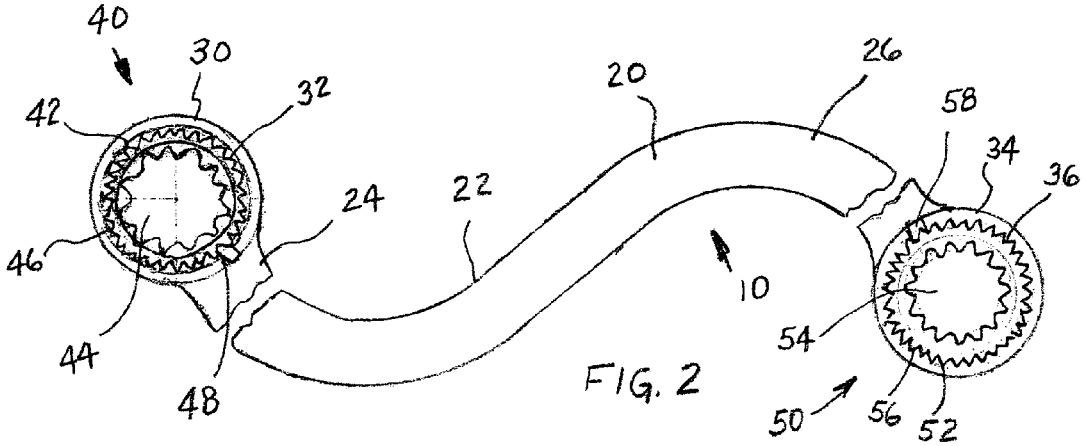
FIG. 2 is a planar view of the ratchet wrench of the present invention.

According to another embodiment of the invention, the ratchet wrench 10 includes at least one ratchet mechanism 60, shown in FIG. 3, which has a ratchet wheel 62 with a square drive 64 outwardly extending from a center of the ratchet wheel 62 and an externally disposed predetermined plurality of ratchet teeth 66. It will be understood that such square drive 64 is adapted for engagement with a conventional socket (not shown).

Alternatively, such square drive 64 may be formed as a portion of an independent socket adapter 70 having an externally disposed polygonal protrusion 72 of a predetermined shape substantially equal to one of the predetermined shape of the internally disposed first polygonal recess 44 of the first ratchet wheel 42 and the predetermined shape of the internally disposed second polygonal recess 54 of the second ratchet wheel 52.

Although the present invention has been shown in terms of the ratchet wrench for removing and installing a compressor mounting bolt on the Cummins engines, models 855 and N14, it will be apparent to those skilled in the art, that the ratchet wrench according to various embodiment of the invention may be used in other applications having difficult to reach fasteners.

Furthermore, the ratchet wrench may be provided with any conventional direction control means engageable with the ratchet mechanism for either reversing or preventing rotation thereof.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A ratchet wrench comprising:

(a) a generally S-shaped body having a shank portion, a first member extending from one end of said shank portion in a first direction and at a first predetermined angle to said shank portion, and a second member extending from an opposed end of said shank portion in a second direction and at a second predetermined angle to said shank portion, said first member and said second member being coplanar;

(b) a first head, having a bore, disposed at a free end of said first member;

(c) a second head, having a bore, disposed at a free end of said second member;

(d) a first ratchet mechanism engageable with said first head, said first ratchet mechanism including a first ratchet wheel disposed within said bore of said first head, said first ratchet wheel having an internally disposed first polygonal recess having a predetermined shape and an externally disposed predetermined plurality of first ratchet teeth, and a first lock pawl engageable with said predetermined plurality of first ratchet teeth to enable rotation of said first ratchet wheel in a first rotational direction; and (e) a second ratchet mechanism engageable with said second head, said second ratchet mechanism including a second ratchet wheel disposed within said bore of said second head, said second ratchet wheel having an internally disposed second polygonal recess having a predetermined shape and an externally disposed predetermined plurality of second ratchet teeth, and a second lock pawl engageable with said predetermined plurality of second ratchet teeth of said second ratchet wheel to enable rotation thereof in a second rotational direction.

2. The ratchet wrench, according to claim 1, wherein said ratchet wrench is rotateably operable in a vertical plane for removal and installation of at least one horizontally disposed fastener.

3. The ratchet wrench, according to claim 2, wherein said at least one fastener is disposed in a difficult to reach location having space limitations.

4. The ratchet wrench, according to claim 2, wherein said at least one fastener is used to attach a compressor to an internal combustion engine.

5. The ratchet wrench, according to claim 1, wherein said second direction of said second member is opposite to said first direction of said first member and forming an offset shape of said body.

6. The ratchet wrench, according to claim 1, wherein a transition between said first member and said shank portion has a first predetermined radius.

7. The ratchet wrench, according to claim 1, wherein a transition between said second member and said shank portion has a second predetermined radius.

8. The ratchet wrench, according to claim 1, wherein said second rotational direction of said second ratchet wheel is one of opposite and identical to said first rotational direction of said first ratchet wheel.

9. The ratchet wrench, according to claim 1, wherein said predetermined shape of said internally disposed second polygonal recess of said second ratchet wheel is substantially identical to said predetermined shape of said internally disposed first polygonal recess of said first ratchet wheel.

10. The ratchet wrench, according to claim 1, wherein said ratchet wrench further includes at least one socket adapter having an externally disposed polygonal portion having a third predetermined shape and a square drive outwardly extending from a center of said socket adapter.

11. The ratchet wrench, according to claim 10, wherein said third predetermined shape of said externally disposed polygonal portion of said socket adapter is substantially equal to one of said first predetermined shape of said internally disposed polygonal recess of said first ratchet wheel and said second predetermined shape of said internally disposed polygonal recess of said second ratchet wheel.

12. The ratchet wrench, according to claim 1, wherein said ratchet wrench further includes at least one direction control means engageable with at least one of said first ratchet mechanism and said second ratchet mechanism for one of reversing and preventing rotation thereof.

13. The ratchet wrench, according to claim 1, wherein a material of said ratchet wrench is steel.

14. A ratchet wrench comprising:

(a) a generally S-shaped body having a shank portion, a first member extending from one end of said shank portion in a first direction and at a first predetermined angle to said shank portion, and a second member extending from an opposed end of said shank portion in a second direction and at a second predetermined angle to said shank portion, said first member and said second member being coplanar;

(b) a first head disposed at a free end of said first member and having a bore;

(c) a second head disposed at a free end of said second member and having a bore;

(d) a first ratchet mechanism engageable with said first head, said first ratchet mechanism including a first ratchet wheel disposed within said bore of said first head, said first ratchet wheel having a first square drive outwardly extending from a center of said first ratchet wheel and an externally disposed predetermined plurality of first ratchet teeth, and a first lock pawl engageable with said predetermined plurality of first ratchet teeth to enable rotation of said first ratchet wheel in a first rotational direction; and (e) a second ratchet mechanism engageable with said second head, said second ratchet mechanism including a second ratchet wheel disposed within said bore of said second head, said second ratchet wheel having a second square drive outwardly extending from a center of said second ratchet wheel and an externally disposed predetermined plurality of second ratchet teeth, and a second lock pawl engageable with said predetermined plurality of second ratchet teeth of said second ratchet wheel to enable rotation thereof in a second rotational direction.

15. The ratchet wrench, according to claim 14, wherein said first square drive and said second square drive are substantially identical.

* * * * *